United States Patent [19]

Falco

[11] Patent Number: 5,072,686

[45] Date of Patent: Dec. 17, 1991

[54] BOOK MARK AND PEN HOLDER

[76] Inventor: Rita J. Falco, 34 Sagamore Dr., Seymour, Conn. 06483

[21] Appl. No.: 696,080

[22] Filed: May 6, 1991

[51] Int. Cl.[5] ..... B42D 9/00

[52] U.S. Cl. ..... 116/234

[58] Field of Search ..... 24/10 R; 116/234-239; 281/42

[56] References Cited

U.S. PATENT DOCUMENTS

| | | | |
|---|---|---|---|
| 1,226,992 | 5/1917 | Paulis | 24/10 R |
| 2,285,000 | 6/1942 | Wallace | 24/10 R |
| 2,300,216 | 10/1942 | Grodsky et al. | 116/237 |
| 3,701,332 | 10/1972 | Brooks | 116/238 |
| 4,838,198 | 6/1988 | Knox | 116/239 |
| 4,984,529 | 1/1991 | Dickson | 116/234 |
| 5,016,559 | 5/1991 | Larson et al. | 24/11 R |

FOREIGN PATENT DOCUMENTS

| | | | |
|---|---|---|---|
| 0024895 | of 1910 | United Kingdom | 24/11 PP |

*Primary Examiner*—William A. Cuchlinski, Jr.
*Assistant Examiner*—W. Morris Worth

[57] ABSTRACT

A combination book marker and pen holder designed so that when the book marker is placed between two pages of a book the pen is oriented in an exposed position extending along the upper edge of the book. The pen is readily accessible for use when needed for marking passages in the book or making notes on the content of the book. The pen holder is adjustable in size to accommodate different diameter pens. A thin flat panel has one end zone extendable beyond the upper edges of the book pages when positioned within the book. The pen holder is mounted on the end zone. The holder is formed from a single strip of material having a flat central strip section and two resilient circular coil sections extending in opposite directions from the flat central strip section so as to be resiliently biased into contact with each other. The coil sections spread apart to releasably retain a pen inserted between the two coils.

2 Claims, 1 Drawing Sheet

BOOK MARK AND PEN HOLDER

BACKGROUND AND SUMMARY OF THE INVENTION

This invention relates to a combination book marker and pen holder.

Persons reading books sometimes desire to underline sentences or passages for future reference. In some cases the person will use a highlighter pen, which has a felt tip for distributing a broad colored transparent line over the printing in the book.

The present invention relates to a book market that has a pen holder incorporated thereon. A person reading a book can store the book marker between the pages of the book with the pen in an exposed position extending along the top edge of the book ready for use if needed, e.g. to underline or highlight passages in the book, or to make notes on a separate piece of paper.

THE DRAWINGS

DESCRIPTION OF A PREFERRED EMBODIMENT OF THE INVENTION

Figure 1:
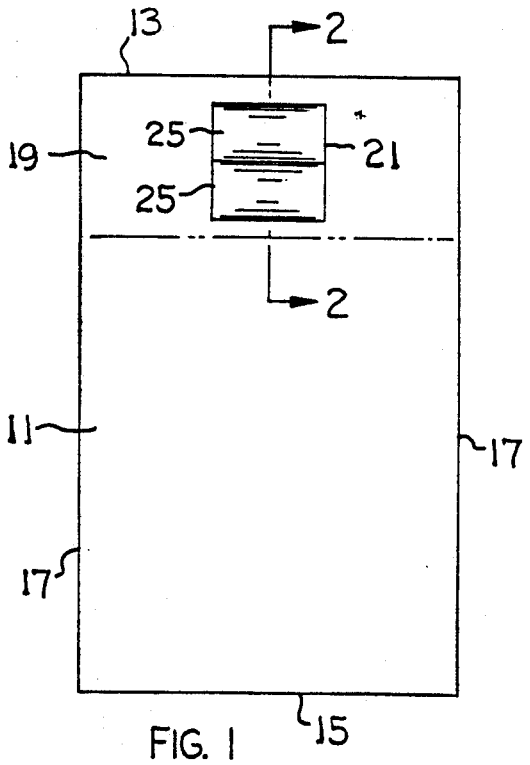
FIG. 1 is a plan view of a combination book marker and pen holder embodying features of the invention.

The drawings show a combination book marker and pen holder that includes a thin flat panel 11 adapted for positionment between the pages of a book (not shown) to indicate the end point of a reading session. While the person is reading the book, panel 11 is stored between pages of the book in a location behind the opened page.

Panel 11 has an upper edge 13, lower edge 15, and two side edges 17. The panel is oriented within the book so that the panel upper edge 13 is located outwardly (upwardly) beyond the upper edge of the book, such that upper end zone 19 of the panel is exposed to view.

A pen holder means 21 is mounted on panel 11 in zone 19, such that when the panel is sandwiched between the pages of a book the pen in holder means 21 extends parallel to the panel surface along the upper edge of the book. A person reading the book has ready access to the pen in the holder means 21.

Figure 2:
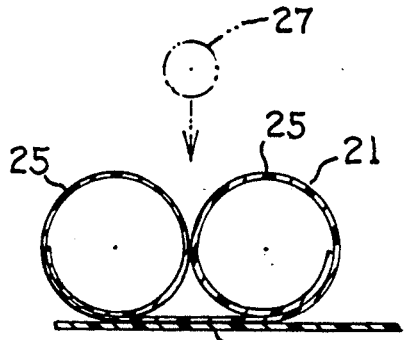
FIG. 2 is an enlarged fragmentary sectional view taken on line 2—2 in FIG. 1.
Figure 3:
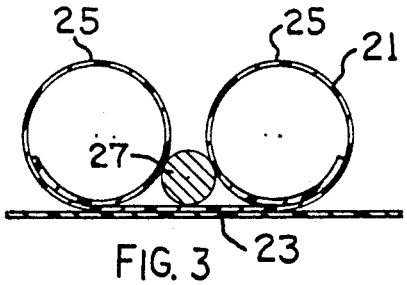
FIG. 3 is a view taken in the same direction as FIG. 2, but showing a small diameter pen located within the pen holder.
Figure 4:
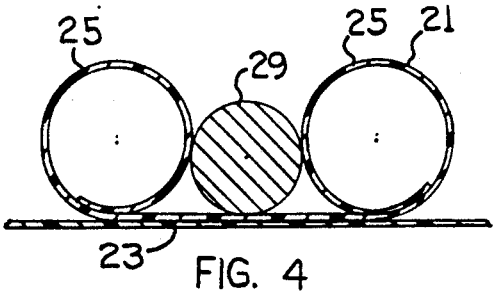
FIG. 4 is a sectional view taken in the same direction as FIG. 2, but showing a larger diameter pen (marker) positioned in the pen holder.

As shown in FIGS. 2 through 4, the pen holder means comprises a single strip of sheet material, preferably plastic, that includes a flat central strip section 23 affixed to the surface of panel 11, and two resilient circular coil sections 25 extending in opposite directions from flat strip section 23. The strip is formed so that in the absence of any external force the two coil sections 25 are in light pressure contact with each other, as shown in FIG. 2.

FIG. 3 shows a cross section through a conventional pen 27 inserted into the space between the two coil sections 25. FIG. 4 shows the condition of the holder when a larger diameter marker pen 29 is inserted into the space (joint) between coil sections 25.

In each case the pen (27 or 29) is inserted into the holder by orienting the pen parallel to the plane of panel 11, and then moving the pen downwardly into the joint between the two resilient coil sections 25. As the pen presses against the coil sections they spread apart to enable the pen to assume the position of FIG. 3 or FIG. 4. The pen is gripped by the resilient coil sections so that it is retained on the exposed portion of panel 11 for use when needed.

Each coil section 25 will have a diameter greater than the diameter of the largest diameter pen that is to be accommodated in the pen holder. The pen holder is adjustable to resiliently grip and retain a range of different diameter pens.

What is claimed is:

1. A combination book marker and pen holder, comprising a thin flat panel adapted for positionment between the pages of a book to indicate the end point of a reading session; said panel having one end zone thereof extendable beyond the upper edges of the book pages when the panel is positioned within the book; and means mounted on said one end zone for holding a pen in a prone position extending generally parallel to the panel surface; said pen holder means comprising a single strip of material that includes a flat central strip section mounted flatwise on the panel surface, and two resilient circular coil sections extending in opposite directions from said flat strip section; said circular coil sections being normally resiliently biased into contact with each other, but being spreadable apart when a pen is moved between the two coil sections, whereby the pen may be releasably retained between the two coil sections.

2. The book marker and pen holder of claim 1, wherein each circular coil section has a diameter slightly greater than the diameter of the largest pen that is to be accommodated in the holder.

* * * * *